United States Patent [19]

Galindo

[11] 4,414,617

[45] Nov. 8, 1983

[54] TRACK LIGHTING SYSTEM

[75] Inventor: Rudolph D. Galindo, Brea, Calif.

[73] Assignees: Bruce Petillo; Stan Pawlowski, both of Placentia, Calif.

[21] Appl. No.: 312,700

[22] Filed: Oct. 19, 1981

[51] Int. Cl.[3] ..... F21S 1/04

[52] U.S. Cl. ..... 362/404; D26/61; 52/28; 362/150; 362/249; 362/250; 362/285; 362/368; 362/370; 362/372; 362/418; 362/430

[58] Field of Search ..... D26/61; 362/150, 404, 362/285, 249, 250, 368, 370, 372, 418, 430; 52/28

[56] References Cited

U.S. PATENT DOCUMENTS 4,109,305 8/1978 Claussen et al. ..... 362/404

*Primary Examiner*—Stephen J. Lechert, Jr.
*Attorney, Agent, or Firm*—Wagner & Bachand

[57] ABSTRACT

A track lighting system comprising an elongated track member including an upstanding web adapted to act as a support point for the system and to provide stiffness thereto. The track member defines a longitudinally extending recess having a throat portion communicating with the side opposite the web and generally exposed to the room in which the track member is to be installed. The system also includes a pair of insulated conductors each extending parallel to each other within the recess and on opposite sides of the throat and a lighting fixture adapted to be mechanically interlocked with the track member for physical support. The lighting fixture also includes a pair of insulation severing blades constituting the electrical connections to the fi

14 Claims, 11 Drawing Figures

TRACK LIGHTING SYSTEM

BACKGROUND OF THE INVENTION

The concept of a track lighting system has been in existence for over two decades while the actual establishment into architectural design has been more recent. Track lighting today is frequently being architectually integrated into the enviornmental design of old and new buildings. The wide-spaced conversions to track lighting systems are for reasons of economics, aesthetics, versatility and simplicity.

Basically track lighting consists of a metal frame or track which is a generally inverted T-shape that is either mounted on or incorporated in a ceiling. Housed in the track are two copper conductors running longitudinally allowing the electrical connection of a variety of types of suspended lighting fixtures at any place along the track. The entire track length is available for insertion of light fixtures so that a large degree of lighting flexibility exists.

Track lighting offers many merits with an outstanding one being versatility. Using lights, one can manipulate man's perception such that moods can be created, points of interest or needed illumination can be emphasized, space can be transformed and room design can be revealed or concealed. These different effects are achieved by choosing a direction, position, color, and/or intensity of a fixture. Track lighting utilizing the possible effects function equally well for display and general illuminating purposes.

Track lighting systems are available which are engineered to act as the grid system for a suspended ceiling system as well. These provide a dual function and it is toward this type of system that this invention is particularly directed.

Of much importance is the economical value of track lighting. Track lighting is economically superior to conventional lighting in that wasteful scatter of light is avoided while adequate illumination to specific areas is made.

Despite the many obvious advantages of track lighting systems there are some limitations, one of which is the inability to convert a traditional ceiling into a track system without putting in a new ceiling. Another limitation or disadvantage of track lighting in general is that there are exposed electrical conductors located within the track which carry 115 volts. The chance of an electrical fire or shock damage does exist with this type of exposed wire.

Traditionally, suspended ceilings have used inexpensive roll formed steel or extruded aluminum grid members. Track lighting systems developed to date for dual use in ceiling grids are significantly more expensive than conventional grids and often are prohibitive in cost for many installations because of the continuous electrical conductors, and the need for special fittings at junctions and edges. Present ceiling grid tack lighting systems further suffer from the disadvantage of having exposed electrical conductors present throughout the grid.

REFERENCE TO RELATED APPLICATIONS

My copending design patent application, Ser. No. 036,330, filed May 7, 1979 now U.S. Pat. No. Des. 236,786, issued Apr. 26, 1983, illustrates an ornamental design for a grid structure particularly useful for embodiment in this invention.

BRIEF DESCRIPTION OF THE INENTION

I have invented a track lighting system which can be installed in a suspended ceiling to be used as a conventional ceiling and converted at a later date to track lighting. In the past this has not been possible. My invention overcomes all of the obstacles as it is not prohibitively expensive and does not require alterations on the framework of the track but simply the installation of a pair of insulated conductors into the system. This system offers added protection over and above the prior art as there are no wires in the system when this invention is to be used as a conventional ceiling and when the system is used for track lighting the conductors used are insulated with conventional plastic insulation.

My invention consists of an elongated track member with an upstanding web which is adapted to give support to the system. The portion of the track member which is exposed to the room has a recess in which the live conductors are placed. The fixtures used for this system are specially adapted such that when the fixture is installed into place, the portion of the fixture which serves to make the electrical connection is equipped with insulation severing blades. Actuation of a plunger drives the insulation cutting blades through the insulation making electrical contact with the longitudinal conductors. The cuts in the insulation are effective in allowing an electrical connection to be made and yet small enough that when the blades are removed the conductors are once again well insulated.

In another embodiment the insulation severing blades are fixed in the connector and sever the conductor insulation when the connector is twisted 90 degrees to secure it mechanically to the track.

BRIEF DESCRIPTION OF THE DRAWINGS

This invention can be more clearly understood from the following detailed description and by references to the drawings in which.

DETAILED DESCRIPTION OF THE INVENTION

Figure 1:
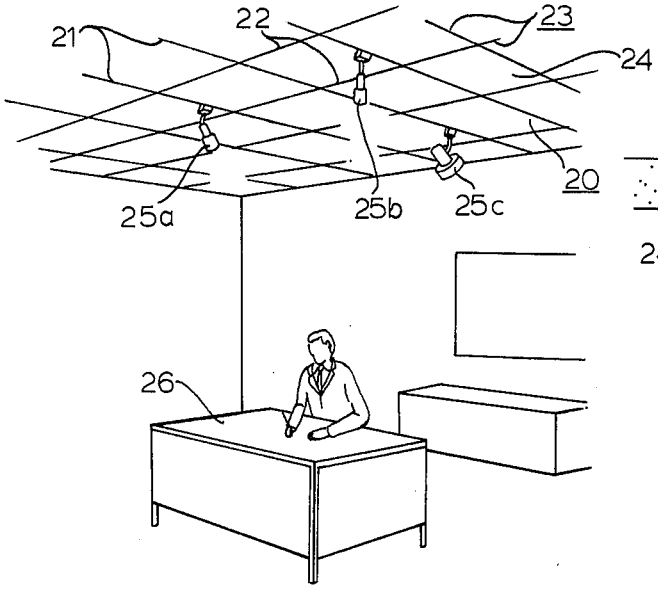
FIG. 1 is a perspective view of an office scene having an acoustical ceiling with an integral lighting track.

For greater detail and understanding of the invention we refer now to the drawings in which an office scene with a suspended ceiling 20, which is a necessary basic component of this invention, is illustrated in FIG. 1. The suspended ceiling 20 is made up of an array of two types of support members, a main support member or main grid 21 and a cross support member 22. The support members 21 and 22 are arranged to define a square or rectangular pattern grid 23. Each opening in the grid 23 is filled with lightweight ceiling panels 24 which are generally constructed of a sound or heat insulating material having a surface treatment which is also aesthetically pleasing. The panels 24 rest on flange portion 35 of the support members illustrated in FIG. 2. For a recommended form of grid member reference is made to my co-pending design patent application, referenced above.

Figure 2:
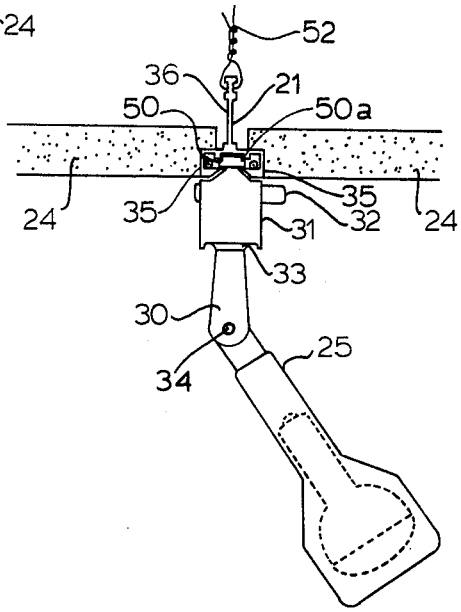
FIG. 2 is a side elevational view of a lamp fixture installed in an end portion of said track.

In accordance with the well known practice in the suspended ceiling art the entire grid 23 is supported from the ceiling by wire hanger 52 one of which is seen in FIG. 2. Three light fixtures 25 are seen in FIG. 1 secured to the main grid members 21 and are directed downward to give specialized lighting effects over the desk 26. The individual fixtures are supported by and receive their power from the main support members 21. The fixtures in this figure are arranged around the area of the desk 26 but may be removed, reinserted and redirected to any position in the room. The main support member or main grid 21 are all electronically powered while the cross members 22 are not, as is true in conventional tack lighting.

For the creative and distinguishing features we look to FIG. 2 which shows a light fixture 25 pivotably connected to a lamp base 30. The lamp base 30 serves as the mechanical pivotal connection between the lamp fixture 25 and the attachment module 31. The attachment module 31 secures the lamp fixture 25 to the main grid or main support members 21 while at the same time provides for the electrical connection between the lamp 25 and a pair of insulated wires 50. A locking button or plunger 32 is seen projecting out of the side of the attachment module 31 and serves to move contacts or knife severing blades which would complete an electrical connection between the conductors 50 and internal contact points best illustrated in FIGS. 6 and 7. Greater detail concerning the electrical connection is discussed in FIGS. 5–7.

Angular adjustment of the fixture 25 occurs at two locations, at the module-base junction 33 and at the base-lamp junction 34. A great amount of flexibility of the lamp exists because of these two junctions so that the lamp can be adjusted to many angles for maximum flexibility. The module 31 may be positioned at any place along the length of any of the grid members 21 of FIG. 1, each of which preferably carry insulated electrical conductors.

Ceiling panels 24 are shown resting on flange portions 35 of the main grid 21. The cross support members supply the rest of the needed support for the paneling but are not shown in this figure. Evident in this figure is an support member or web 36 which extends vertically from the exposed portion of the main grid 21. The entire grid system is held up by wire hangers 52 which extend through a hole in the web 36 and then are fastened to the ceiling or beams of a building.

Figure 2A:
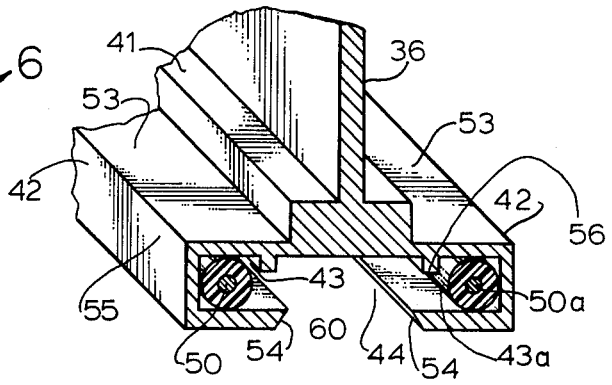
FIG. 2A is an enlarged perspective fragmentary view of a section of a main rib of the system of FIG. 1 showing the conductors in place.

For greater detail concerning the design of the main grid 21 used in this invention we look now to FIG. 2A The main grid 21 is made up of a web 36 which functions as a form of support for the grid, a body portion 41 and two box portions 42. The two box portions 2 extend laterally on each side of the body 41 and each define a hollow recess 43 and **43*a* in which insulated wiring 50 and 50*a*** respectively are held. This is a major point of difference from conventional lighting tracks in that insulated wiring so is utilized and the circuit carrying portion of the track is integrally constructed into the track design itself and may be used either with or without lighting.

My invention has two notable advantages over the prior art; cost and safety. The cost is less due to its design simplicity and the use of conventional insulated wire. The system has an added degree of safety in that the wiring used is fully insulated. The recess 43 is located within an upper track wall 53 of the box portion 42, a mitered flange 54, a side wall 55, and a small rib 56 which projects down from the upper wall 53. An opening 60 to the box portion 42 still exists and it is through this opening that the wiring is installed either manually or by a special tool. A channel or raceway 44 exists between the tow box portions 42. Light fixtures are attached in the raceway 44. Whether or not fixtures are attached the appearance of the track is aesthetically pleasing. This is of particular importance in this invention because this system can be installed as a suspended ceiling without any wiring and then later converted to the track lighting system by installing the insulated wiring 50.

Once wiring is installed it is secure, as well as being out of view because of the shape of the mitered flange 54 and ribs 56. Both of these projections keep the wiring positioned within the recess 43.

Figure 3:
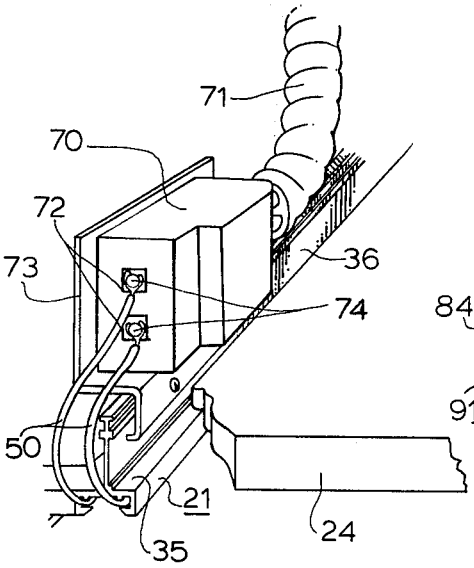
FIG. 3 is a perspective view of a 12 volt transformer and its attachment to the track lighting system of this invention.

To see on form of electrical interconnection used in this invention we refer now to FIG. 3 which shows a step down transformer 70 mounted by means of a mounting bracket 73 on a main support member 21 and supported as part of the ceiling. The step down transformer 70 reduces the voltage applied to conductors 50, in this case from 115 v line voltage arriving in a conduit or Bx cable 71 to 12 v available at the two output terminals 72. This type of transformer is commonly used for two reasons: (1) safety, and (2) many lamps and track lighting systems are designed to operate from 12 v. The output terminals 72 have low voltage wires or insulated wiring 50 attached by tightening screw 74. The low voltage wires 50 feed into the recess 43 of the main grid 21 thus the grid is supplied with a source of power. The single stepdown transformer 70 will supply several different pairs of wires securing the other main support members 21. Evident in this figure is the relationship between the lightweight ceiling panels 24 and grid members 21 illustrating how they rest on the flange portion 35.

Figure 4:
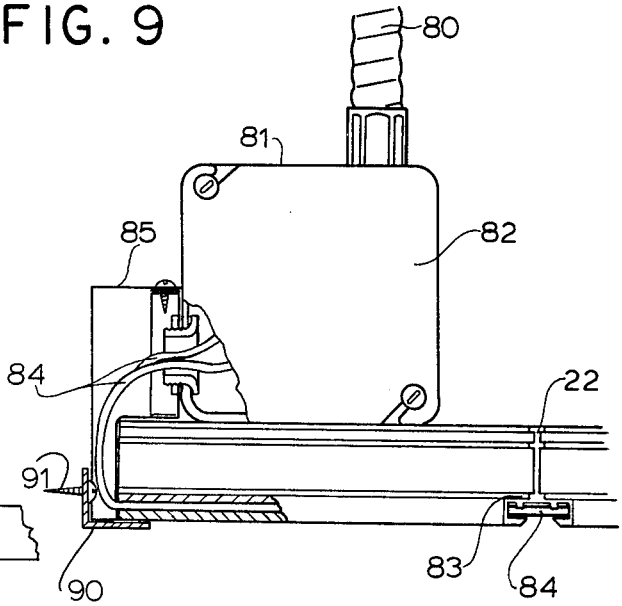
FIG. 4 is a front elevational view of a 120 volt junction box as it is situated on the track.

A high voltage or normal supply voltage system 7 is illustrated in FIG. 4 in which the conduit 80 joins an outlet box 81 with its cover 82 in place from which 115 v carrying conductors 84 emerge and then go through a rib end box 85 to enter the recess 43 similar to the lower voltage wires seen in FIG. 3. In FIG. 4 a track junction 83 between a cross member 22 and the main grid member 21 is shown. The 115 volt carrying conductors 84 extend through the junction and are uninterrupted. A perimeter bracket 90 is shown near the end box 85 which secures the track and in this case junction box 81 to the side wall (not shown) by means of a mounting screw 91.

Figure 5:
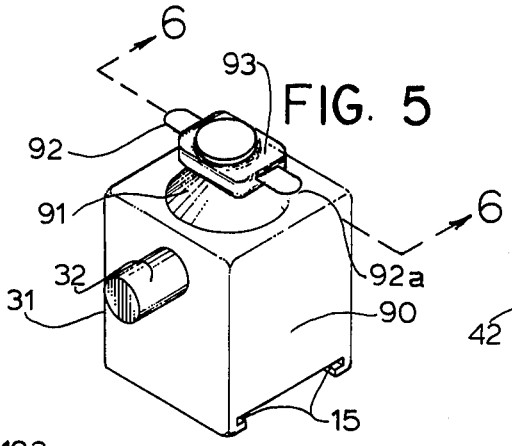
FIG. 5 is an isometric view of a connector used in this invention.
Figure 6:
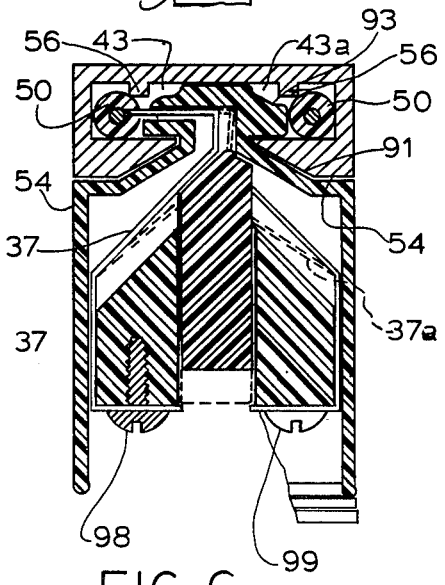
FIG. 6 is a vertical sectional view of the connector of FIG. 5 taken along lines 6—6 of FIG. 5 and shown in place in a mitered ceiling member.

The attachment of lighting fixtures to the track 21 which is seen in FIGS. 1–4 is acheived by an attachment module 31 which is the subject of the next figure, FIG. 5. All track lighting systems utilize an attachment module of some sort. The attachment module in this figure serves a dual function; it mounts a light fixture to the main grid and makes an electrical connection to insulated wires. The insulation severing blades or contacts 92 and 92*a*, when in place, provide for the electrical connection when the module and lamp is in place. The attachment module 31 is made up of a module body 90 where a tapered neck 91 rests. Located on the neck 11 is a head portion 93 which is inserted into the raceway 44 of the main grid 21 not shown in this figure.

The module 31 is installed in a raceway 44 and rotated 90 degrees when insertion into the raceway 44 is attempted. Most track lighting systems utilize a module of some sort. This module differs in that the contacts that make the electrical connection between the conductors and the light fixture are a pair of insulation piercing knives 92 which cut through the insulation covering the conductors and make a connection. The insulation used in this invention is Underwriters Laboratories approved "resealable" type where when the knives are withdrawn and the fixture is moved to another location the insulation at the earlier location reseals itself. A suitable type of insulated wire is 10 to 14 gauge copper two conductor polyvinyl chloride (PVC) insulated wire wire of American Insulated Wire Corporation of Pawtucket Rhode Island.

The procedure to electrically engage the module 31 is as follows:

The plunger or locking button 32 is fully depressed covering an internally located contact driver 33 causing it to move vertically along inclined surfaces 37 and 37*a* and to flex spring sections 93 and 93*a* of contacts 92 and 93*a* outward and drive the knife blade through the insulation of conductors 50. The blades are shown in their engaging position while the non-engaged position is illustrated by dashed lines in FIG. 7 moving horizontally, penetrating the insulation of the electrical conductors. Near the base 14 of the module 31, a locking slot 15 for a lamp base is shown. It is here that a lamp or lighting fixture is secured to the module 31.

Figure 7:
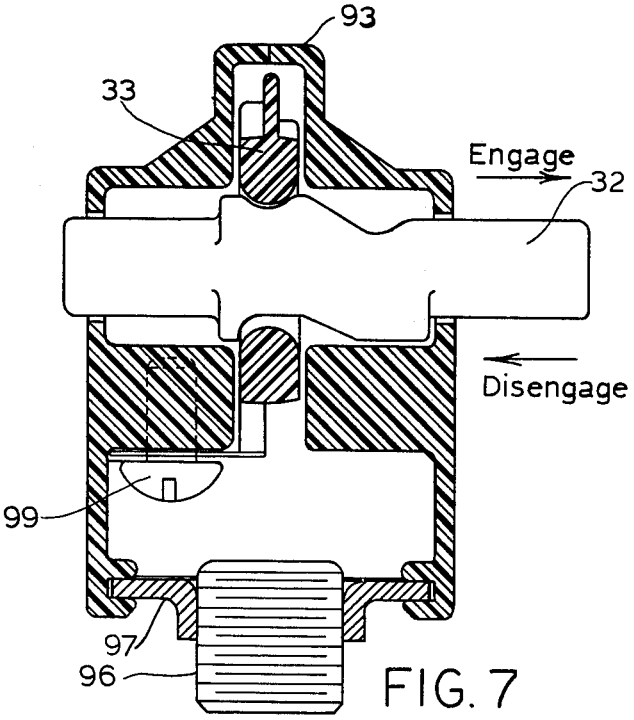
FIG. 7 is a side vertical sectional view of the right side of the connector of FIG. 5 taken along lines 7—7 of FIG. 5.
Figure 10:
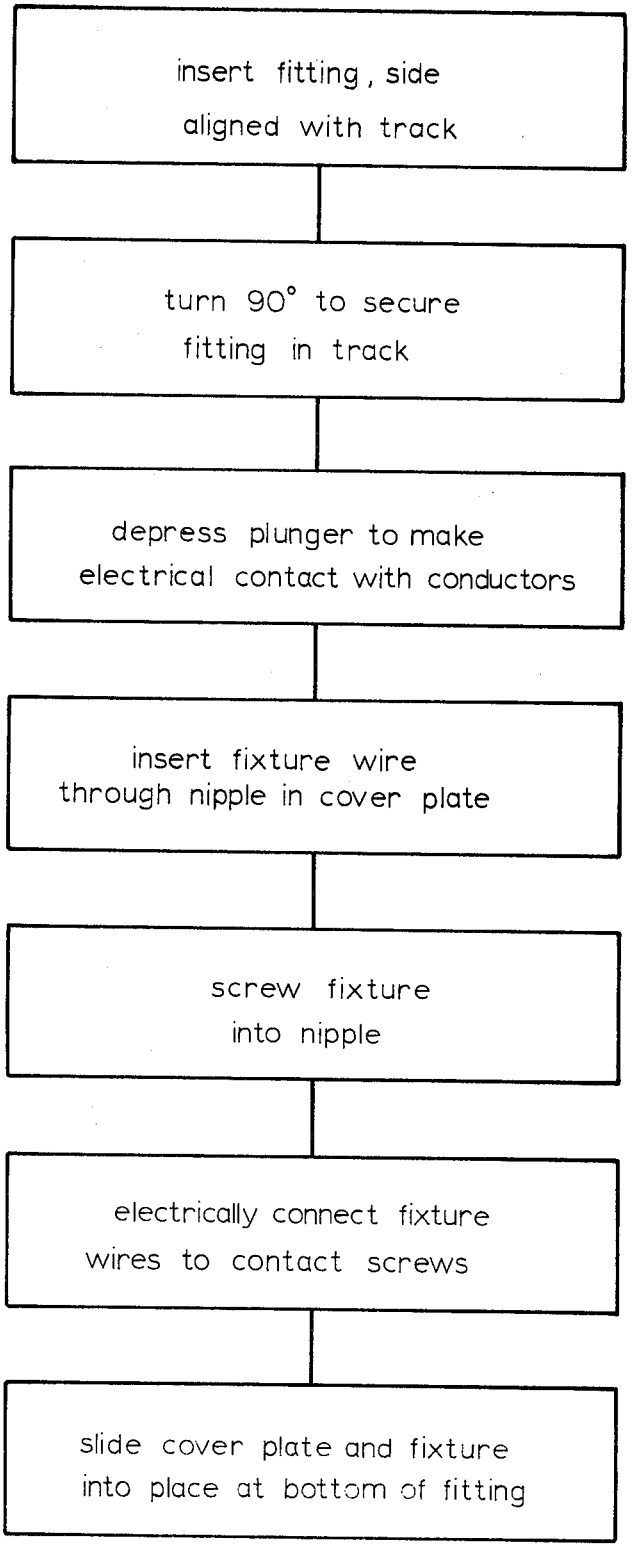
FIG. 10 is a flow plan of the process of mounting a fixture according to this invention.

To better understand the union of the attachment module 31 and the main grid 21 we now refer to FIG. 5 in conjunction with FIG. 7, the latter of which affords a sectioned view of this relationship. The head 93 and shoulder 91 are seen inserted into the raceway with the head 93 captured within the recesses 43 nd 43*a* and the shoulder 91 bearing against the beveled surfaces 54. The head 93 has sufficiently narrow sides to allow the head 93 to be inserted through the opening 44 (of FIG. 2*a*) before turning 90 degrees and mechanically locking into place. The top button of the head 93 limits the extent of entry of the head into the recess 44. The attachment module 31 is shown to be made up of insulating material such as acrylonitrile-butadaene styrene (ABS) produced by the Dow Chemical Company of Midland, Mich.

The head 93 comes in vertical contact with the insulated conductors 50 and ribs 56 and thereby guides the knife edges of contacts 92 directly to the conductor 50. The knives 92 are offset such that this sectioned view shows only one knife 92 making actual contact with the conductor 50. The knives 92 are made of beryillium copper which allows for an electrical connection as well as the necessary resilience for the invention. Beryillium copper is commonly used in lamps for just this reason. The knife 92 is guided into contact with the insulated wiring 50 by a plastic housing 93. In this figure the knife 92 is shown in contact with the conductor 50 because the pluner 32 (of FIG. 7) is in the depressed position forcing the contact driver 33 upward. When the plunger 32 is released the contact driver 33 returns to the base 14 of the module 31.

Figure 8:
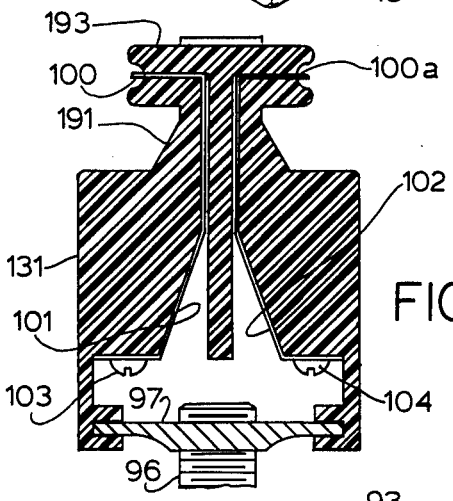
FIG. 8 is a vertical sectional view of an alternate embodiment of this invention showing fixed cutting blades.

Refer now to FIG. 8 where an alternate embodiment employing fixed contact knives 100 and 100*a* are used. In this case the module 131 includes shoulder portions 191 and head portion 193 of a configuration generally similar to that of FIG. 5. One exception is that the ends of the head 93 are recessed/expanded to conform to the conductor 50 insulation to carefully guide the knives 100 and 100*a* through the insulation and into contact with the conductor 50 when the module 31 is rotated 90 degrees upon insertion and locking in the grid. The two blades 100 and 100*a* are integral with respective conductors 101 and 102 which are secured in place by respective contact screens 103 and 104. Electrical contact to conductors 50 of the grid of FIG. 1 is obtained through the screws 103 and 104 by conductors from a lighting fixture coming through the nipple 96 threaded into retainer plate 97.

Figure 9:
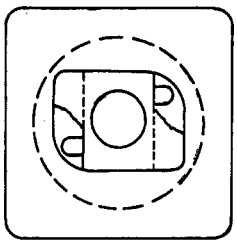
FIG. 9 is a top plan view of the alternate embodiment of FIG. 8 with portions broken away for clarity.

A flow plan for the installation procedure of a fitting into the main grid or track 21 shown in FIG. 9, should be considered in connection with FIGS. 2 and 7. The first step is to insert fitting or module 31 without its place 97 and nipple 96 in the grid member 21 with the head aligned with the track. Next turn the module 90 degrees to secure the fitting into the track. Then the plunger 32 is depressed to make electrical contact with the conductors 50. The fixture 25 is secured to the module by inserting fixture wires through the nipple 96 and coverplate 91. Then the fixture is onto the nipple. At this time there are two separate assemblies, a module 31 and a fixture-base 30 or nipple assembly. Connection of the two is made in the final two steps. The fixture is electrically connected by attaching it to the contact screws and finally the cover plate and fixture is slid into place at the bottom of the fitting.

Any angular adjustments of the fixture can be made at this time.

The installation of the embodiment of FIG. 8 is basically the same however the step of depressing the plunger is unnecessary since electrical connection is automatically achieved by the previous 90 degree securing step.

The above described embodiments of this invention are merely descriptive of its principles and are not to be considered limiting. The scope of this invention instead shall be determined from the scope of the following claims, including their equivalents.

I claim:

1. A track lighting system comprising an elongated track member including an upstanding web adapted to act as a support point for the system and to provide stiffness thereto;

said track member defining a longitudinally extending recess having a throat portion communicating with the side opposite the web and generally exposed to the room in which the track member is to be installed;

a pair of insulated conductors extending parallel to each other within said recess and on opposite sides of said throat;

a lighting fixture support adapted to be mechanically interlocked with said track member for physical support;

said lighting fixture including a pair of insulation severing blades constituting the electrical connections to said fixture; and means for selectively moving said blades into insulation piercing and electrical contact making relationship with said conductors in said recess.

2. A lighting fixture for use with track lighting systems including insulated conductors within a recess and adapted to be mechanically interlocked with such system for physical support and electrical connection comprising:

a body adapted to mechanically interlock in the recess of said track lighting system;

a pair of insulation severing blades constituting the electrical connection to said fixture;

said pair of blades carried by said body; and means for selectively moving said blades into insulation piercing and electrical contact making relationship with said conductors in said recess.

3. The combination in accordance with claim 1 and 2 wherein said blades are flexibly mounted with respect to said lighting fixture support and wherein said blade moving means comprises a member movable with respect to said lighting fixture support to flex said blades sufficiently to engage locally and penetrate the insulation on said insulated conductors and to make contact with respective conductors.

4. The combination in accordance with claim 3 wherein said blades include an integral flexible portion within said lighting fixture support and said movable member is positioned to simultaneously flex said blades outward into insulation penetrating engagement with both said conductors.

5. The combination in accordance with claim 4 wherein said movable member includes a plunger and cam means movable on response to movement of said plunger to flex said blades.

6. The combination in accordance with claim 5 wherein said cam means is located between said blades in the flexible region thereof and includes two cam surfaces for flexing said blades in opposite outward directions.

7. The combination in accordance with claim 1 wherein said track includes a transversely extending recess and a restricted throat region, and said fixture support includes a head narrower in one direction to pass through said throat and wider in another direction to be supported within said track member.

8. The combination in accordance with claim 7 wherein said blades extend through the wider portion of said head in position to penetrate the insulation of said conductors when said fixture support is secured to said track.

9. The combination in accordance with claim 8 wherein said head includes restricted passages therethrough for guiding said blades toward the insulated conductors.

10. The combination in accordance with claim 1 and 2 wherein said selectively moving means comprises the fixture support body and wherein said blades are fixedly secured thereto and extending out of said fixture support in the region interlocked with said track member and adjacent to said conductors whereby movement of said support into interlocking arrangement with said track moves said blades into insulation penetrating contact with said conductors.

11. The combination in accordance with claim 10 wherein said lighting fixture support includes a head portion narrower in one direction than the throat of said track member and wider than the throat in a second direction whereby said lighting fixture support is engagable with said track by insertion and turning of said fixture support by approximately 90 degrees, wherein said fixed blades extend from the wider portion of said head.

12. The combination in accordance with claim 11 wherein the wider portion of said head includes a longitudinally extending groove dimensioned to generally correspond with the external dimension of the insulated conductor, and said blades are each located within respective grooves.

13. An electrically powerable track for use in a track lighting system comprising:

an elongated track member including an upstanding web adapted to act as a support point for the track member and to provide stiffness thereto;

said track member defining a longitudinally extending recess having a throat portion communicating with the side of said track member opposite said web and generally exposed to the room in which the track member is to be installed;

a pair of fully insulated conductors extending parallel to each other within said recess and on opposite sides of said throat with the insulation of said conductors exposed for penetration by sharpened conductive means insertable through said throat into said recess.

14. The combination in accordance with claim 13 including rib means within said recess defining restrictive opening within said recess for retention of said fully insulated conductors within said recess.

* * * * *